US005654524A

United States Patent [19]

Saxby

[11] Patent Number: 5,654,524

[45] Date of Patent: Aug. 5, 1997

[54] TARGET MARKING BULLET

[75] Inventor: Michael Ernest Saxby, Bexhill-on-Sea, Great Britain

[73] Assignee: Constantia (International) Ltd., Queensway, Gibraltar

[21] Appl. No.: 649,626

[22] PCT Filed: Nov. 24, 1994

[86] PCT No.: PCT/GB94/02578

§ 371 Date: May 24, 1996

§ 102(e) Date: May 24, 1996

[87] PCT Pub. No.: WO95/14903

PCT Pub. Date: Jun. 1, 1995

[30] Foreign Application Priority Data

Nov. 25, 1993 [GB] United Kingdom ..... 9324253

[51] Int. Cl.[6] ..... F42B 12/40

[52] U.S. Cl. ..... 102/513; 102/502; 102/529

[58] Field of Search ..... 102/444, 445, 102/502, 511, 512, 513, 529; 273/418

[56] References Cited

U.S. PATENT DOCUMENTS

| | | | |
|---|---|---|---|
| H114 | 8/1986 | Quintavalle . | |
| 3,419,274 | 12/1968 | Tabor | 102/513 |
| 3,429,263 | 2/1969 | Snyder et al. | 102/513 |
| 3,528,662 | 9/1970 | Merchant . | |
| 3,782,286 | 1/1974 | Jones et al. . | |
| 3,820,465 | 6/1974 | Delphia | 102/512 |
| 3,894,492 | 7/1975 | Barr et al. | 102/502 |
| 4,128,059 | 12/1978 | Black . | |
| 5,018,449 | 5/1991 | Eidson, II . | |
| 5,233,128 | 8/1993 | Lai | 102/511 |

FOREIGN PATENT DOCUMENTS

| | | |
|---|---|---|
| 1263522 | 2/1972 | United Kingdom . |

*Primary Examiner*—Harold J. Tudor
*Attorney, Agent, or Firm*—Dowell & Dowell

[57] ABSTRACT

A projectile has a hollow casing (1, 2) with a perforated nose portion (11), a piston (3) disposed within the casing, and a marking substance (4) disposed forwardly of the piston. The piston (3) is movable forwardly under force applied to it by gas used to discharge the projectile. The marking substance (4) is thereby compressed and expelled through the nose portion for contact with a target.

8 Claims, 1 Drawing Sheet

TARGET MARKING BULLET

BACKGROUND OF THE INVENTION

1. Field of the Invention

This invention is generally directed to marking bullets or projectiles which contain a dye substance used for marking a target upon impact.

2. History of the Related Art

It is known to issue security forces with marking bullets which may be fired at selected persons in a crowd of rioters, for example, in order to mark them with an indelible dye. Such bullets may also be used for training purposes, when they may be fired at persons taking part in training exercises, or at targets.

The known marking bullets are so formed as to burst when they strike a medium hard surface at an impact force of less than 3 ft/lbs. Because of their nature, the known marking bullets must be handled carefully and are not suited for use in weapons which re-load automatically.

The marking bullet proposed herein overcomes this problem and is capable of accepting a degree of rough handling and, in particular, of being used in automatic weapons.

DESCRIPTION OF THE PREFERRED EMBODIMENT

Figure 1:
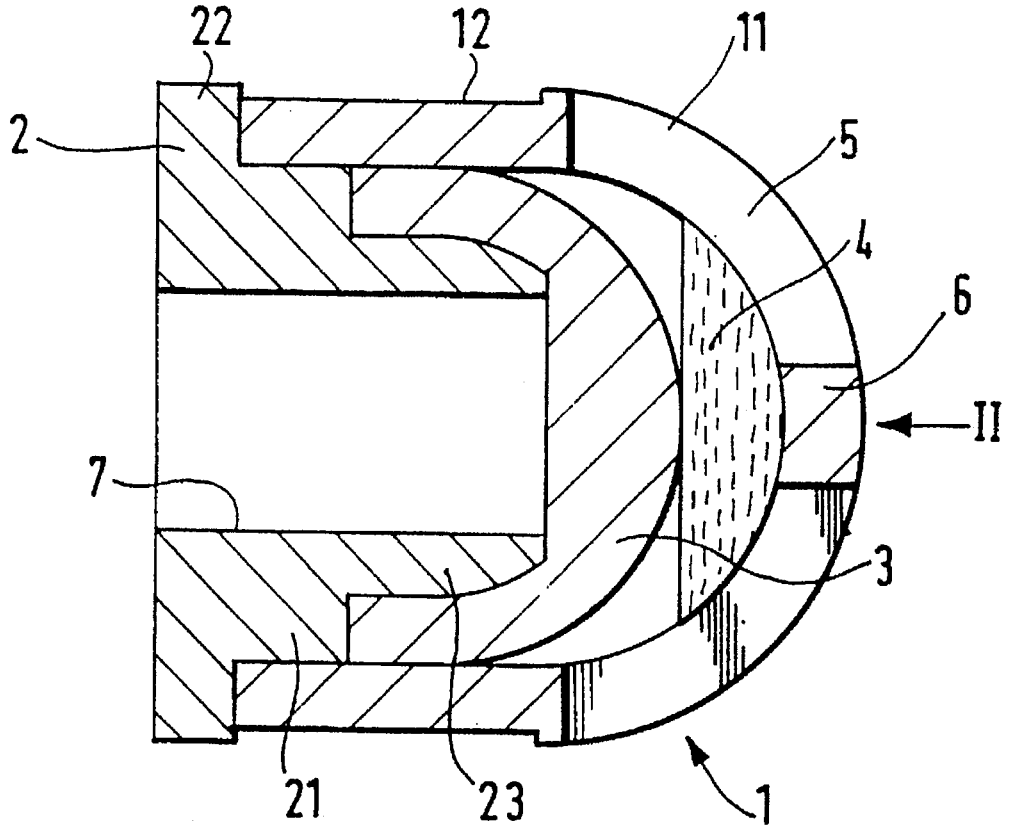
FIG. 1 is a longitudinal section through the proposed bullet taken on the line I—I in FIG. 2.
Figure 2:
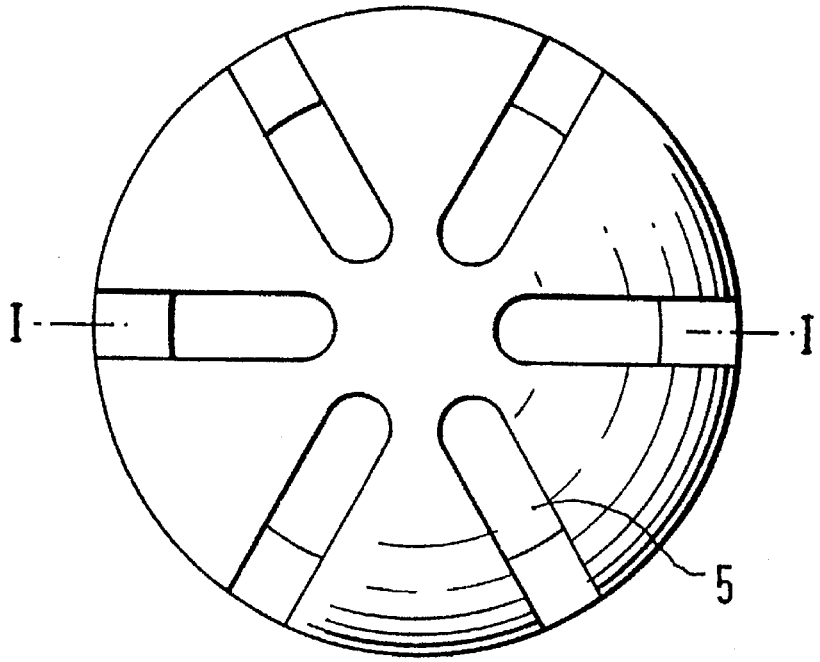
FIG. 2 is an end view looking in the direction of arrow II in FIG. 1.

Referring to the drawings, the proposed marking bullet comprises a hollow case formed from an outer shell 1 and insert 2. The shell 1 has a dome shaped nose portion 11 from which a cylindrical sleeve 12 extends rearwardly. The insert has a mid-portion 21 which is fitted tightly within the sleeve 12, a shoulder portion 22 which abuts against the rearward edge of the sleeve 12, and a smaller diameter spigot 23 projecting forwardly from the mid-portion. Slidably fitted onto the spigot is a piston 3 which has a domed head generally complementary in shape to the inner side of the dome shaped nose portion 11.

The nose portion 11 has an array of slots 5 extending radially from a central hub portion 6 and contains a dye formed by a mass 4 of spreadable, semi-solid material, which may have a gelatinous, greasy or pasty consistency, and be in the nature of the material used to form conventional lipstick.

Extending through the insert 2 is an axial bore 7 to enable the bullet to be mounted on a spigot projecting from a suitably adapted cartridge. Alternatively the bullet may be held in place by the rim of the cartridge in the conventional way, but will nevertheless be provided with a bore connecting the rear face of the piston to atmosphere at the trailing end of the bullet. Upon firing, the gas serving to propel the bullet from the barrel of a weapon penetrates through the bore 7 and drives the piston 3 forwards to nest within the nose 11. The piston thereby expels the dye through the slots 5. The exterior of the nose 11 is thereby covered in a layer or film of dye which applies itself to the target when the latter is struck by the bullet.

The case of the bullet is formed from a light weight material such as hard plastic, aluminum or magnesium alloy.

The material which is used should allow a bullet to be manufactured which is strong enough to withstand rough handling and automatic cycling but light enough to impact on the target at below 3 ft/lbs impact force. The dye carried by the bullet does not come into contact with the hands of personnel or with gun mechanisms during handling and loading, but is made to coat the exterior of the nose 11 by the time the bullet has been ejected from the weapon. Because the nose 11 has a smooth outer surface on which the dye may form a thin, easily removable greasy coating, the bullet will mark anything that it touches, even at low impact forces or with a glancing blow.

The nose 11 may be formed with a single slot, or with one or more openings other than slots, or may have a mesh-like structure.

It falls within the scope of the invention for the insert 2 to he omitted, provided that the piston is retained within the case in such a way that it will not part from the case during flight. The bullet may be used in conjunction with conventional pyrotechnic or gas cartridges. It is, however, within the scope of the invention for the bullet to be propelled from guns in which a projectile is discharged by air or gas pressure without the use of a cartridge.

I claim:

1. A marking projectile comprising, a hollow casing having a nose portion, an insert within a rear end of the casing, a piston disposed between the insert and the nose portion, the insert having a bore extending therethrough, the bore being open to a rear surface of the piston and to the rear end of the casing for conducting to the rear surface of the piston propellant gas used to propel the projectile from a gun, the casing defining a chamber between the piston and nose portion, the nose portion having perforations therethrough opening into the chamber and a marking substance containing a dye disposed in the chamber defined between the piston and nose portion, whereby upon firing of the gun the propellant gas drives the piston forwards to cause the marking substance to be expelled through the perforations in the nose portion to form a coating on the nose portion prior to ejection of the projectile from the gun.

2. A projectile which is discharged utilizing force of propellant gases comprising:

a hollow casing having a forward end and a rear end, said casing having at least one perforation in its said forward end;

a marking substance containing a dye contained within the casing so as to be in open communication with said at least one perforation which is open and unobstructed said marking substance comprising a semi-solid material of such consistency as not to escape through said at least one perforation during handling and loading of the projectile, and pressure applying means within said casing for applying pressure to said marking substance in order to expel it through said at least one perforation in the forward end thereof to form a coating on the forward end prior to the ejection of the projectile from a gun for contact with a target;

wherein said pressure applying means applies pressure to said marking substance by utilizing the force of the propellant gases used to discharge the projectile.

3. A projectile as claimed in claim 2, wherein said pressure applying means includes a piston disposed rearwardly of said marking substance between said forward and rear ends of said casing.

4. A projectile as claimed in claim 3, wherein said piston has a generally domed surface, and said forward end of said casing has an inner face substantially complementary in shape to said domed surface of said piston.

5. A projectile as claimed in claim 4, wherein the said forward end is perforated by a plurality of radially extending slots.

6. A projectile as claimed in claim 5, wherein said piston is slidable on a spigot extending forwardly from an insert fitting into said rear end of said casing.

7. A projectile as claimed in claim 6, wherein said insert has an axial bore extending therethrough and opening to a rear surface of said piston.

8. A marking projectile for ejection from a gun using a propellant gas comprising, a hollow casing having a nose portion, an insert within a rear end of said casing, a piston disposed between said insert and said nose portion, said insert having a bore extending therethrough, said bore being open to a rear surface of said piston and to said rear end of said casing for conducting to said rear surface of said piston the propellant gas used to propel the projectile from the gun, said casing defining a chamber between said piston and said nose portion, said nose portion being provided with slots opening therethrough into said chamber so as to provide communication between said chamber and an exterior of said nose portion of said casing, a marking substance containing a dye disposed in said chamber, said marking substance being a semi-solid material which will not flow through said slots unless pressure is applied thereto to force said marking substance through said slots, whereby upon firing of the gun the propellant gas drives the piston forwards to cause said marking substance to be expelled through said slots in said nose portion to form a coating on said exterior of said nose portion prior to ejection of the projectile from the gun.

* * * * *